United States Patent [19]

Pohorski

[11] 4,415,539

[45] Nov. 15, 1983

[54] CONTAINER STERILIZER AND DISCHARGE SYSTEM

[75] Inventor: Daniel W. Pohorski, San Jose, Calif.

[73] Assignee: James Dole Corporation, Redwood City, Calif.

[21] Appl. No.: 352,993

[22] Filed: Feb. 26, 1982

Related U.S. Application Data

[63] Continuation-in-part of Ser. No. 236,766, Feb. 23, 1981.

[51] Int. Cl.[3] ..... A61L 2/06

[52] U.S. Cl. ..... 422/304; 34/181; 34/182; 219/388; 422/1

[58] Field of Search ..... 422/304, 303, 302, 1, 422/28, 38; 34/182, 181; 53/425, 426, 471, 473, 488, 490, 141, 279, 282, 281, 287, 167; 219/388

[56] References Cited

U.S. PATENT DOCUMENTS

| | | | |
|---|---|---|---|
| 2,480,227 | 8/1949 | Derr | 422/1 X |
| 2,771,645 | 11/1956 | Martin | 422/304 |
| 2,835,003 | 5/1958 | Abrams | 422/304 |
| 2,870,024 | 1/1959 | Martin | 422/302 X |
| 3,087,209 | 4/1963 | Monk | 422/304 |
| 3,348,659 | 10/1967 | Roinestad | 198/778 |
| 3,437,422 | 4/1969 | Guckel | 422/304 |
| 3,783,581 | 1/1974 | Pierce | 53/426 |

*Primary Examiner*—Barry S. Richman
*Attorney, Agent, or Firm*—Julian Caplan

[57] ABSTRACT

In a hot air aseptic canning system, containers are sterilized by hot air in an adaptation of a commercially available machine. In accordance with the improvement of the present invention, hot air is blown into the tops of the containers to displace ambient air trapped therein and thus lower the time required to sterilize the containers. As the containers travel along a helical conveyor, inside an insulated housing, they pass under off-center nozzles having openings in their bottoms to cause swirling of air within the containers. The nozzles are connected by ducts to a source of sterilizing air. As the containers leave the conveyor, with their axes vertical, they travel side-by-side down a waterfall with their axes horizontal, then onto a rapidly moving horizontal conveyor which carries the containers away as rapidly as they reach the bottom of the waterfall, and then are turned to vertical position and directed into a filler.

6 Claims, 7 Drawing Figures

CONTAINER STERILIZER AND DISCHARGE SYSTEM

This invention relates to a new and improved container sterilizer and discharge system therefor. Reference is made to co-pending U.S. application Ser. No. 06/236,766 filed Feb. 23, 1981, of which the present application is a continuation-in-part. The contents of said prior application are incorporated herein by reference.

The present invention is useful, particularly in the aseptic sterilizing of containers having fiber bodies and metal ends. Fiber-body containers have less heat conductivity than metal body containers, and this causes a lag in heating the interior of the container. However, the present invention is useful in other types of containers, including metal, glass and plastic. Ambient, non-sterile air is present in the containers as they are fed into the sterilizer. In accordance with the present invention, sterile, heated air is blown into the open mouths of the containers to displace the air originally therein. Such sterile, heated air is delivered into the containers from nozzles which are positioned immediately above the path of the containers, such nozzles having openings in the bottom thereof, through which hot air is discharged.

Thus a feature of the present invention is the reduction in the time which a container must remain in the sterilizer, thereby increasing its capacity.

A still further advantage of the invention is the reduction in energy requirements for aseptic conditioning of the container.

A still further feature of the invention is the fact that the containers are less likely to be damaged in that they are subjected to sterilizing conditions for a shorter period of time and are optionally later cooled before product is filled therein. This feature of the invention is of particular advantage over steam sterilization of containers wherein the steam may cause deterioration of the laminating material of fiber containers.

In accordance with the present invention, the containers move abreast along a spiral conveyor. In the embodiment illustrated, the containers are three abreast. They may be single file or abreast in multiple numbers. The discharge system directs the containers from the spiral conveyor into a "waterfall" from the top of the sterilizer apparatus to the bottom thereof and thence into single file for delivery to a filler.

Another advantage of the discharge system is the fact that the speed of the spiral conveyor may be reduced without lowering its capacity in accordance with practice of the present invention.

A still further feature of the invention is the reduction in likelihood in jamming of the containers in the sterilizer.

Other objects and advantages of the parent application Ser. No. 236,766 are present in the present invention. Thus, although steam aseptic packaging systems and methods have been used commercially for many years and the substitution of heated gases, including air, for steam is noted in the literature, the use of hot air in accordance with the present invention as contrasted with steam offers a considerable number of important advantages.

An important advantage in the use of hot air is the saving in energy required to vaporize water to create steam. Somewhat increased volume of heated air has the same lethality as super-heated steam. Recirculation of the heated air provides increased energy conservation and fuel savings.

Hot air, as contrasted with steam, also reduces the deterioration of parts of the system which have been attacked by steam and also lessens the saturation of the insulation of the casing and consequent lessening of thermal insulation efficiency thereof.

Fiber containers are laminated with the use of adhesives. Steam tends to attack these adhesives, whereas such attack is considerably less for hot air sterilization.

Other objects of the present invention will become apparent upon reading the following specification and referring to accompanying drawings in which similar characters of reference represent corresponding parts in each of the several views.

Figure 1:
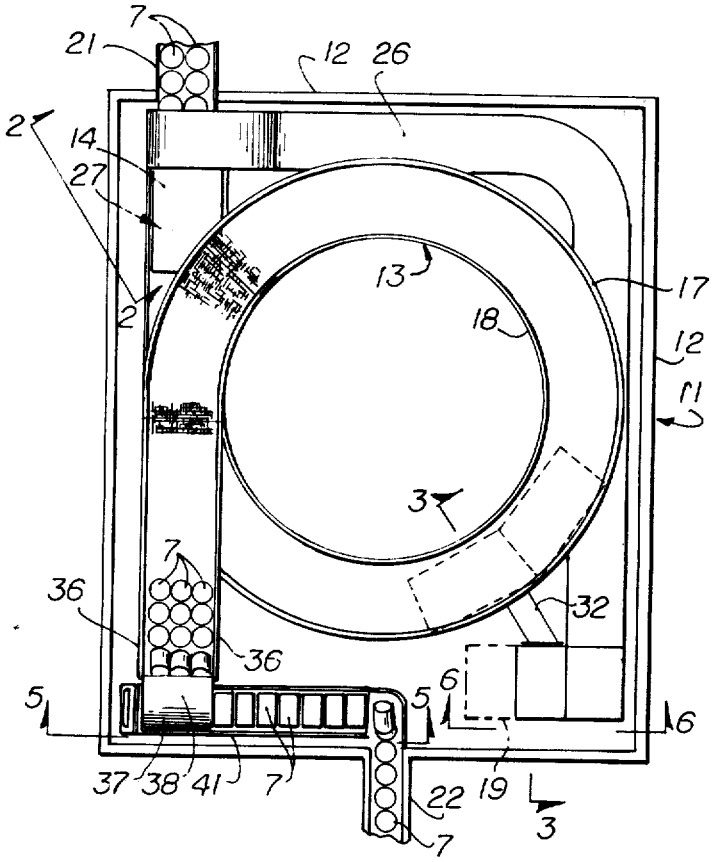
FIG. 1 is a somewhat schematic horizontal section view taken adjacent the top of a hot air sterilizer in accordance with the present invention.

Containers 7 are of various types. In one embodiment of the invention, containers 7 have laminated fiber bodies having open tops 8 and metal bottoms 9.

Sterilizer 11 is shown in greater detail in the aforesaid co-pending application, Ser. No. 236,766. For practical purposes, it may be considered that the sterilizer 11 has double walls 12, filled with insulating material. A helical conveyor 13 extends upward from the bottom. The construction of the coneyor 13 is subject to wide variation. As here shown, it consists of a stainless belt which at the bottom passes around intake pulley 14 and at the top passes around discharge pulley 16. Guide 17 consists of rods or angles which define the perimeter of the helical path of the conveyor. A cage 18 on the interior of the conveyor 13 is caused to revolve by means not herein illustrated or described. The conveyor and its actuating mechanism are an adaptation of a commercially available machine. The number of containers handled is subject to variation. As here shown there are three containers 7 on the conveyor 13 extending radially outward from the center of the conveyor. For smaller diameter containers, more rows of containers may be handled.

As disclosed in the aforesaid parent application Ser. No. 236,766, a heater and blower (not shown) are installed on or in proximity to the sterilizer 11. In the preferred embodiment herein illustrated, the heater and blower are on the top (not shown) of the machine. The blower delivers sterile air to the main duct 23. A portion of the air from duct 23 enters the casing of sterilizer 11 through inlet duct 19 and is deflected by deflector 24 into the interior of the sterilizer. A portion of the air delivered through duct 23 is diverted by secondary duct 26 downward and around to adjacent inlet conveyor 21.

Figure 2:
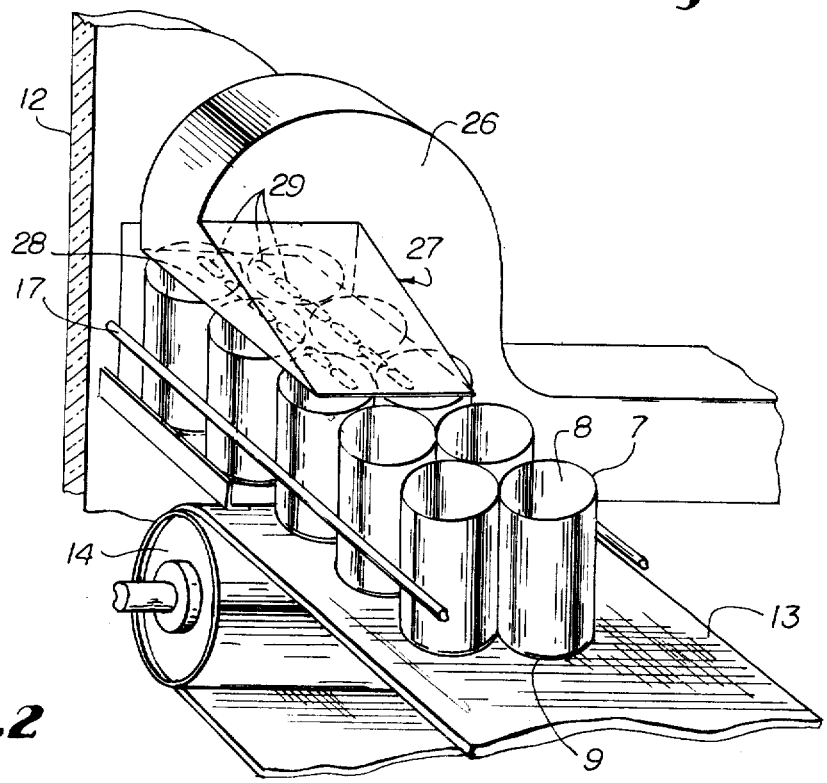
FIG. 2 is a fragmentary, enlarged perspective view taken substantially along the line 2—2 of FIG. 1.
Figure 5:
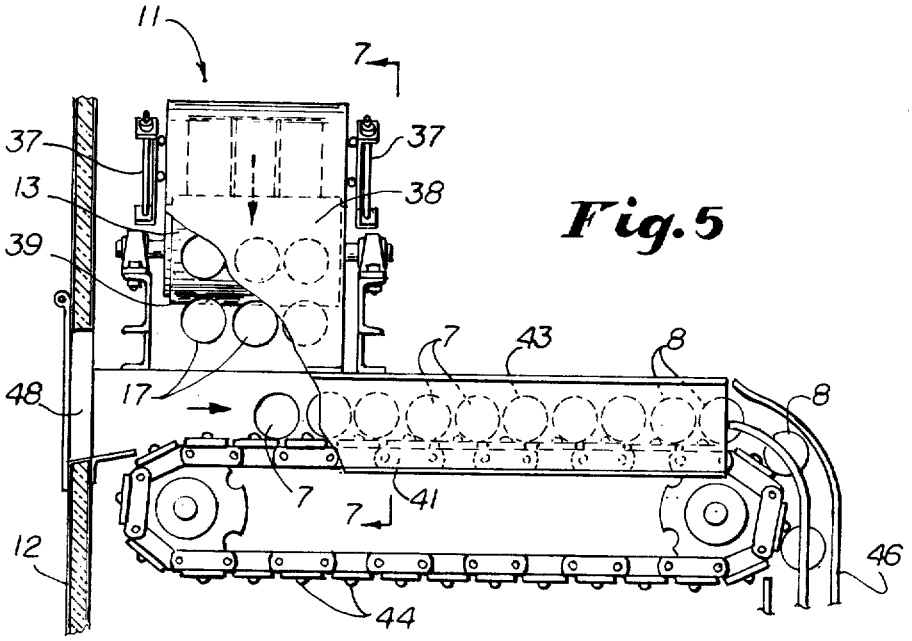
FIG. 5 is a perspective view in enlarged scale of a portion of the waterfall discharge of the sterilizer.
Figure 7:
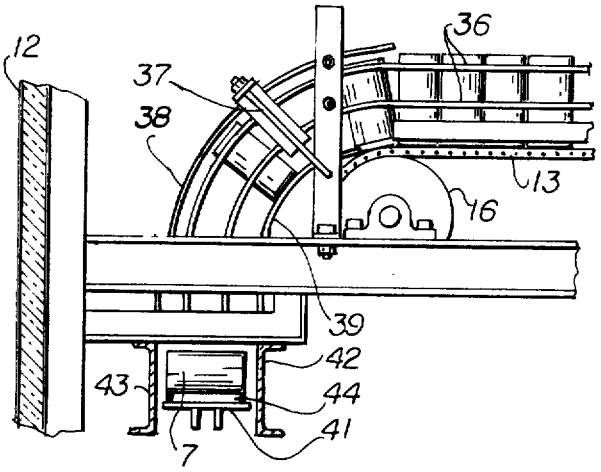
FIG. 7 is a sectional view taken substantially along the line 7—7 of FIG. 5.
Figure 6:
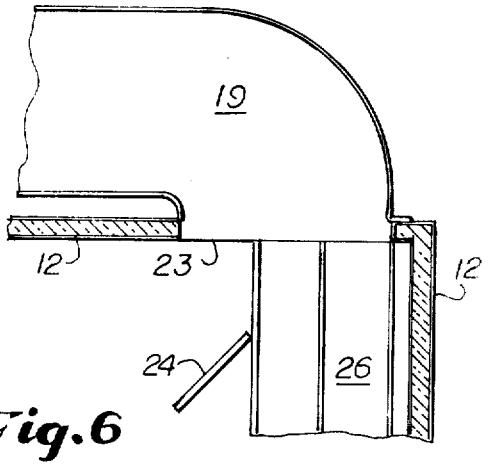
FIG. 6 is a fragmentary sectional view taken substantially along the line 6—6 of FIG. 1.

Containers 7 with their open tops 8 uppermost are delivered in non-sterile condition into the machine through inlet conveyor 21 preferably in double file and, after the containers have been sterilized are discharged through outlet conveyor 22. As has been previously mentioned, particularly where the walls of the container are of fiber and are of lesser heat conductivity than metal containers, the ambient air originally in the containers tends to remain stagnant therein. One means of displacing the stagnant, non-sterile air is shown in FIG. 2. Thus the secondary duct 26 terminates in a sheet metal nozzle 27 having converging sides which is generally triangular in side elevation and has a flat bottom 28 positioned above the tops 8. Bottom 28 is formed with a plurality of holes 29, here shown as being elongated oblongs. The hot air is thus delivered directly into the containers 7 through their open tops 8 as they pass from the inlet conveyor 21 onto the belt conveyor preferably off-center closer to the inner edge, thus causing a swirling of the air therein. Bottom 28 is at an elevation slightly higher than the tallest containers to be used. The containers preferably crowd into three abreast array after passing nozzle 27.

Figure 3:
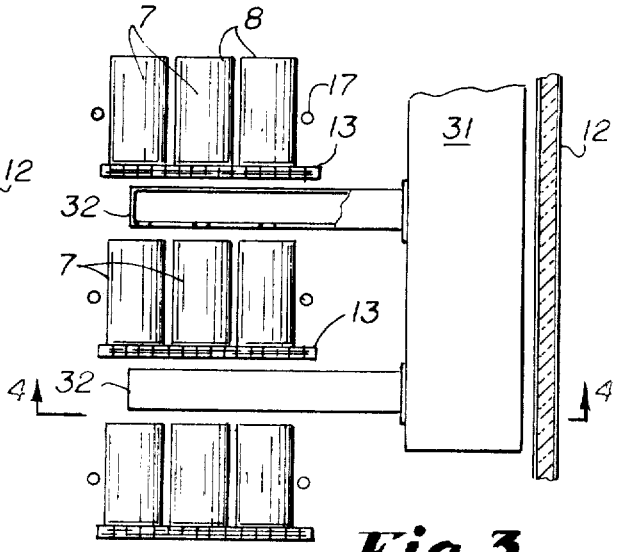
FIG. 3 is an enlarged, vertical sectional view taken substantially along the line 3—3 of FIG. 1.

As an alternate or supplement to the nozzle 27 shown in FIG. 2, additional nozzles 32 are illustrated in FIG. 3. The location of the nozzles 32 shown in FIG. 3 is subject to variation as is the number thereof. As shown, nozzles 32 are diagonally opposite inlet conveyor 21.

Thus, main duct 23 leads into a second secondary duct 31 which extends vertically down one of the walls 12. As shown, there are three nozzles 32 extending outward over the conveyor 13 and over the tops of the containers 7 on three levels of the conveyor 13. It will be understood that the number of nozzles 32 and their shapes is subject to variation. The bottoms 33 of nozzles 32 are elevated slightly above the tops of the tallest containers to be handled.

Figure 4:
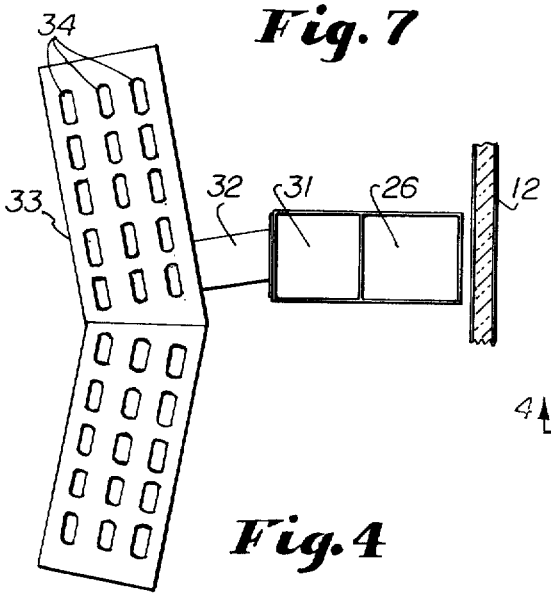
FIG. 4 is a fragmentary bottom plan view of a portion of the structure of the sterilizer as viewed substantially along the line 4—4 of FIG. 3.

As shown, there are three rows of containers 7 and accordingly there are three rows of holes 34 in the bottom 33 of each nozzle 32 so as to deliver sterile, hot air into the open tops 8. As best shown in FIG. 4, the nozzle 32 is extended in a roughly arcurate shape to overlie a sector of the conveyor 13.

Thus, as it passes through the sterilizer 11, each container 7 is subjected to external heated air at a temperature of about 200°-400° F. for fiber containers and higher for metal or glass containers and at the same time at various intervals, it is subjected to air of the same or higher temperature blown into the interior of the cans through their open tops. By the time the containers reach the discharge conveyor 22, they are in aseptic condition.

In a preferred embodiment of this invention, the containers 7 travel from the bottom upwardly in a helical path until they reach approximately the position of the discharge pulley 16. As the containers approach the discharge pulley 16, they are traveling horizontally and approximately tangentially to the main spiral conveyor 13. Guides 36 on either of the path of the containers 7 curve in downward stretches 37. To prevent the containers from falling off the conveyor, they are enclosed within curved top 38 and curved bottom 39 which are spaced slightly greater than the height of the container being handled. Such structure is commonly termed in the industry a "waterfall" or discharge chute. A distinguishing feature of this particular waterfall is that if there are three containers abreast as they reach the waterfall, they remain in the same array as they fall with their axes horizontal to the bottom.

At the bottom of the waterfall, the cans are horizontal and are deposited onto a rapidly moving horizontal conveyor 41 which may be provided with lugs 44. The direction of movement of conveyor 41 is perpendicular to the container axes and at a speed sufficient to take the containers away as rapidly as they reach the bottom of the waterfall. Surplus cans, in excess of the ability of conveyor 41 and susequent stations to handle them are discharged through door 48 and side 12. Inner and outer end guides 42, 43 confine the ends of the containers. As best shown in FIG. 1, the containers 7 are discharged from the inner end of the conveyors 41 and fall downward in single file onto a vertical position with the open ends uppermost on the outlet conveyor 22 where they may be cooled under sterile conditions and delivered into a filler section of the type shown in the aforesaid pending application Ser. No. 236,766.

What is claimed is:

1. A hot air aseptic packaging system container sterilizer, comprising a casing, a conveyor within said casing, means for feeding empty containers onto said conveyor with their open tops uppermost in a plurality of side-by-side rows, means for discharging containers from said conveyor, heating means, said heating means comprising a heater for raising the temperature of air to a sterilizing temperature, blowing means for blowing heated sterilizing air above atmospheric pressure, a first duct from said blowing means to said casing to distribute heated sterilizing air at a pressure throughout said casing to sterilize said containers as they pass on said conveyor through said casing, a second duct communicating with said first duct, a nozzle on said second duct having a flat bottom positioned over a portion of the path of travel of said containers along said conveyor, said bottom being elevated above the top of said conveyor, said bottom being apertured in a plurality of rows of apertures, each row presenting a plurality of apertures positioned to direct hot sterile air into said containers at a position off center relative to said containers, thereby causing a swirling motion of air within said containers to direct hot sterile air into said containers.

2. A sterilizer according to claim 1 in which said conveyor comprises a belt, a cage and means for guiding and driving said belt in a continuous helical path around the exterior of said case and around a vertical axis, and which further comprises a plurality of second nozzles communicating with said second duct, each of said second nozzles having its flat apertured bottom over a different level of said helical path, whereby hot sterile air is directed into each container a plurality of times as it travels around said conveyor.

3. A sterilizer according to claim 2 in which each said second nozzle is approximately arcuate in plan to overlie a considerable arcuate portion of the travel of said container.

4. A sterilizer according to claim 2 in which said first mentioned nozzle is located diametrically opposite said second nozzles relative to said helical path.

5. A sterilizer according to claim 2 in which said helical path extends from bottom to top of said casing and which further comprises means to form a plurality of rows of containers on said belt as said containers move off said means for feeding said containers, means to guide said belt in a tangential stretch at the upper ends of said belt and to confine said containers in said plurality of rows, means for turning said plurality of rows from vertical to horizontal axis position, a second conveyor extending horizontal along one side of said casing, means for driving said second conveyor at a linear speed such as to take said containers away as rapidly as they reach said second conveyor, and means at the end of said second conveyor to tilt said containers to the vertically upright position as they are delivered to said means for discharging containers.

6. A sterilizer according to claim 5 in which said means for turning said plurality of rows of containers comprises a first side guide on a first side of said means, a second side guide on the opposite side of said means spaced from said first side to accommodate a plurality of said containers side-by-side, said first and second side guides having arcuate upper portions and vertical lower portions, a top having an arcuate upper portion having the same center of curvature as said arcuate upper portions of said side guides and a vertical lower portion and a bottom having an arcuate upper portion having the same center of curvature as said upper portions of said side guides and a vertical lower portion, said lower portions of said top and bottom being spaced apart a slightly greater distance than the height of a container.

* * * * *